US011688966B1

(12) United States Patent
Shen et al.

(10) Patent No.: US 11,688,966 B1
(45) Date of Patent: Jun. 27, 2023

(54) ELECTRIC POWER CONNECTOR WITH LATCHING FUNCTION

(71) Applicant: YFC-BONEAGLE ELECTRIC CO., LTD., Taoyuan (TW)

(72) Inventors: Sheng-Cheng Shen, Taoyuan (TW); Qing Chen, Wuxi (CN); Jiajia Yao, Wuxi (CN)

(73) Assignee: YFC-BONEAGLE ELECTRIC CO., LTD., Taoyuan (TW)

( * ) Notice: Subject to any disclaimer, the term of this patent is extended or adjusted under 35 U.S.C. 154(b) by 27 days.

(21) Appl. No.: 17/584,355

(22) Filed: Jan. 25, 2022

(51) Int. Cl.
*H01R 13/193* (2006.01)
*H01R 13/115* (2006.01)

(52) U.S. Cl.
CPC ..... *H01R 13/193* (2013.01); *H01R 13/115* (2013.01)

(58) Field of Classification Search
CPC .. H01R 13/193; H01R 13/115; H01R 13/112; H01R 13/05; H01R 13/28; H01R 13/4538; H01R 13/62911; H01R 33/76; H01R 33/46; H01R 33/72; H01R 33/74
See application file for complete search history.

(56) References Cited

U.S. PATENT DOCUMENTS 4,136,919 A * 1/1979 Howard ..... H01R 13/20 439/346
5,352,132 A * 10/1994 O'Keefe ..... H01R 13/62 439/346
5,893,772 A * 4/1999 Carmo ..... H01R 13/639 439/348
6,193,539 B1 * 2/2001 Chang ..... H01R 13/6278 439/346
7,347,708 B1 * 3/2008 Huang ..... H01R 13/639 439/263
7,484,986 B1 * 2/2009 Wu ..... H01R 13/6275 439/346
8,184,441 B2 * 5/2012 Meng ..... H05K 5/0278 361/752
8,308,494 B1 * 11/2012 Zhao ..... H05K 5/0278 439/131
8,382,507 B2 * 2/2013 Yamaguchi ..... H01R 13/6275 439/369
9,548,574 B2 * 1/2017 Hsu ..... H01R 13/7038
9,917,402 B1 * 3/2018 Campbell ..... H01R 13/62911
10,714,862 B1 * 7/2020 Yu ..... H01R 13/20
2008/0220636 A1 * 9/2008 Champion ..... H01R 13/665 439/131

* cited by examiner

*Primary Examiner* — Harshad C Patel
(74) *Attorney, Agent, or Firm* — Chun-Ming Shih; HDLS IPR Services

(57) ABSTRACT

An electric power connector for a connective terminal to be plugged in, which includes a carrier, a clamping member, a driven element, a sliding element, and a gear. The clamping member is disposed in the carrier and clamps the connective terminal. The driven element is movably disposed in the carrier and is arranged correspondingly to the clamping member. The sliding element is slidably connected in the carrier and includes a rack and a pushing portion. The gear is rotatably connected to the carrier and engages with the rack. The sliding element is configured to slide relative to the carrier by controlling the gear to rotate. The pushing portion moves with the sliding element to push the driven element to shift to force the clamping member to latch the connective terminal.

15 Claims, 6 Drawing Sheets

ELECTRIC POWER CONNECTOR WITH LATCHING FUNCTION

BACKGROUND

Technical Field

The disclosure relates to an electric power connector, particularly to an electric power connector with a latching function.

Related Art

An electric power connector can be connected with a corresponding connector to allow connective terminals of the corresponding connector to be plugged in a clamping member for electric connection.

To prevent the electric power connector and the corresponding connector from separating from each other, the related-art electric power connector has been provided with an anti-loosening ring or an anti-loosening arm for holding the corresponding connector, so that the electric power connector and the corresponding connector can be prevented from improperly separating from each other.

However, the engagement or disengagement of such an anti-loosening ring or an anti-loosening arm must be exerted with a considerable force. This is a drawback, especially for the elders or children. For those who have weaker hand strength, implementing the engagement or disengagement of an electric power connector and a corresponding connector is difficult. Incomplete engagement frequently occurs.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

SUMMARY

An object of the disclosure is to provide an electric power connector with a latching function, which may force the clamping member to latch the connective terminal by pushing the driven element so as to prevent the electric power connector and the corresponding connector from improperly separating from each other.

To accomplish the above object, the disclosure is to provide an electric power connector with a latching function for a connective terminal to be plugged in, which includes a carrier, at least one clamping member disposed in the carrier and clamping the connective terminal, at least one driven element movably disposed in the carrier and arranged correspondingly to the clamping member, a sliding element slidably connected in the carrier and having a rack and a pushing portion, and a gear rotatably connected to the carrier and engaged with the rack. The sliding element is configured to slide relative to the carrier by controlling the gear to rotate. The pushing portion moves with the sliding element to push the driven element to shift to force the clamping member to latch the connective terminal.

In comparison with the related art, the disclosure has the following functions. The electric power connector and the corresponding connector may be prevented from improperly separating from each other to achieve a firmly latching effect. The disclosure has the effect of easy operation for both latching or unlatching.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 5:
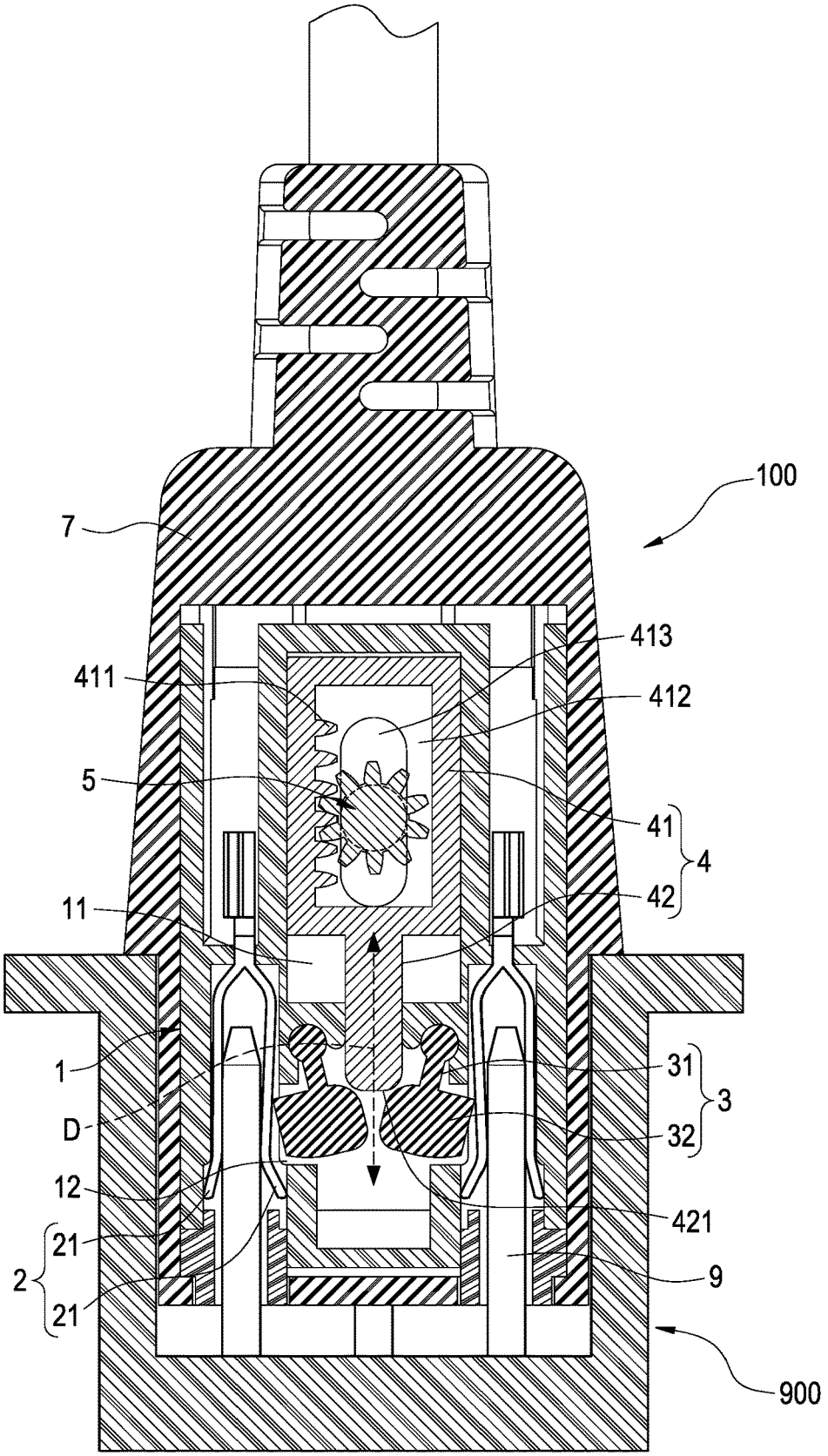
FIG. 5 is a cross-sectional view of the electric power connector with a latching function of the disclosure before assembling the control member when a connective terminal is plugged but not latched yet.

The disclosure provides an electric power connector with a latching function, as shown in FIG. 5, which is used for connecting with a corresponding connector 900 to make a connective terminal 9 of the corresponding connector 900 be plugged in a clamping member 2 of the electric power connector with a latching function (hereinafter "electric power connector 100").

As shown in FIGS. 1-4, the electric power connector 100 of the disclosure includes a carrier 1, at least one clamping member 2, at least one driven element 3, a sliding element 4 and a gear 5, and may further include a control member 6. The disclosure does not limit the amount of the clamping member 2 and the driven element 3, which may be one, or equal to or more than two. For example, one driven element 3 is associated with two clamping members 2 (not shown) and the driven element 3 is correspondingly arranged on a side of either one of the two clamping members 2, or one driven element 3 is associated with three clamping members 2 (not shown).

Each clamping member 2 is disposed in the carrier 1. The clamping member 2 may be any component which is used to clamp the connective terminal 9. The embodiment uses the following description as an example: the clamping member 2 has two clamping arms 21 which are configured to flexibly clamp, and the connective terminal 9 is clamped between the two clamping arms 21.

Figure 1:
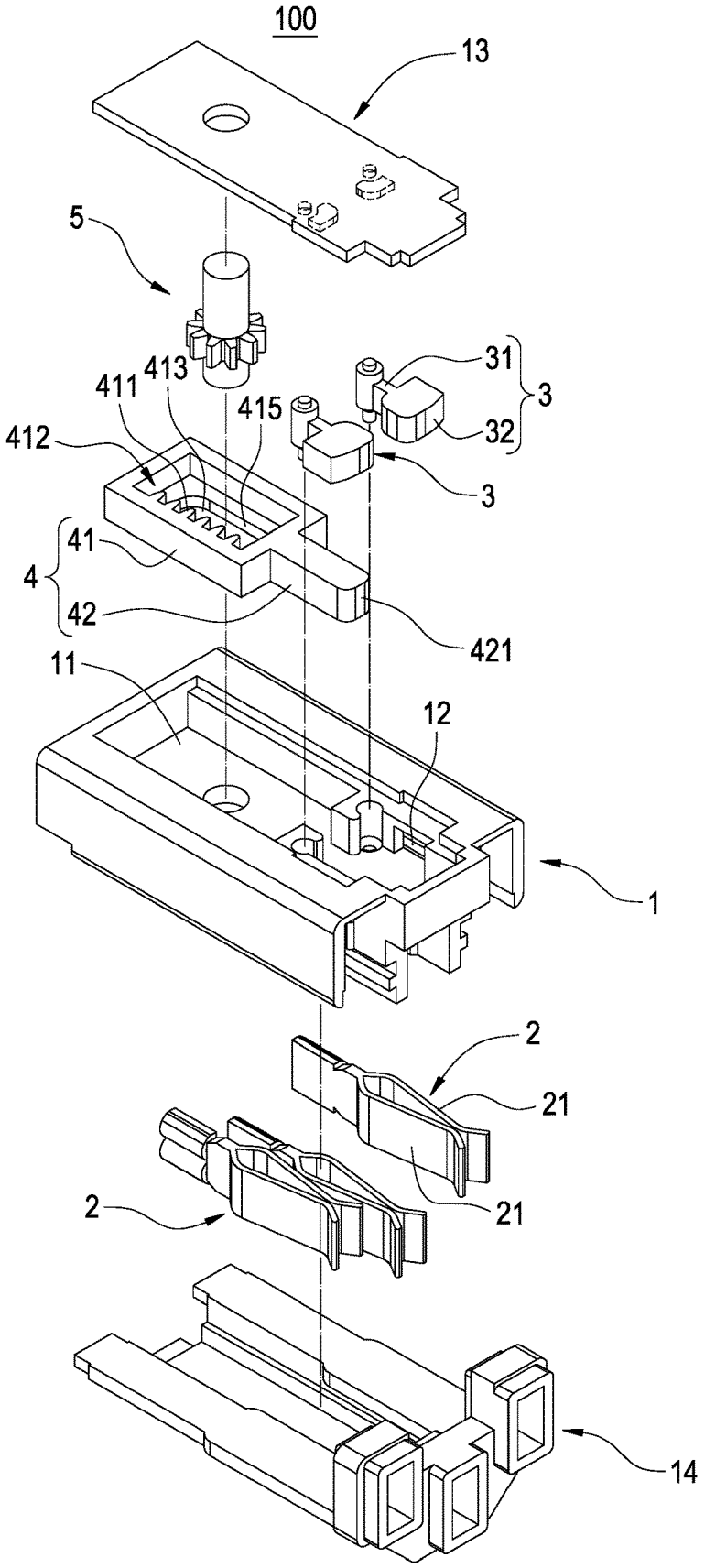
FIG. 1 is an exploded view of the electric power connector with a latching function of the disclosure.
Figure 3:
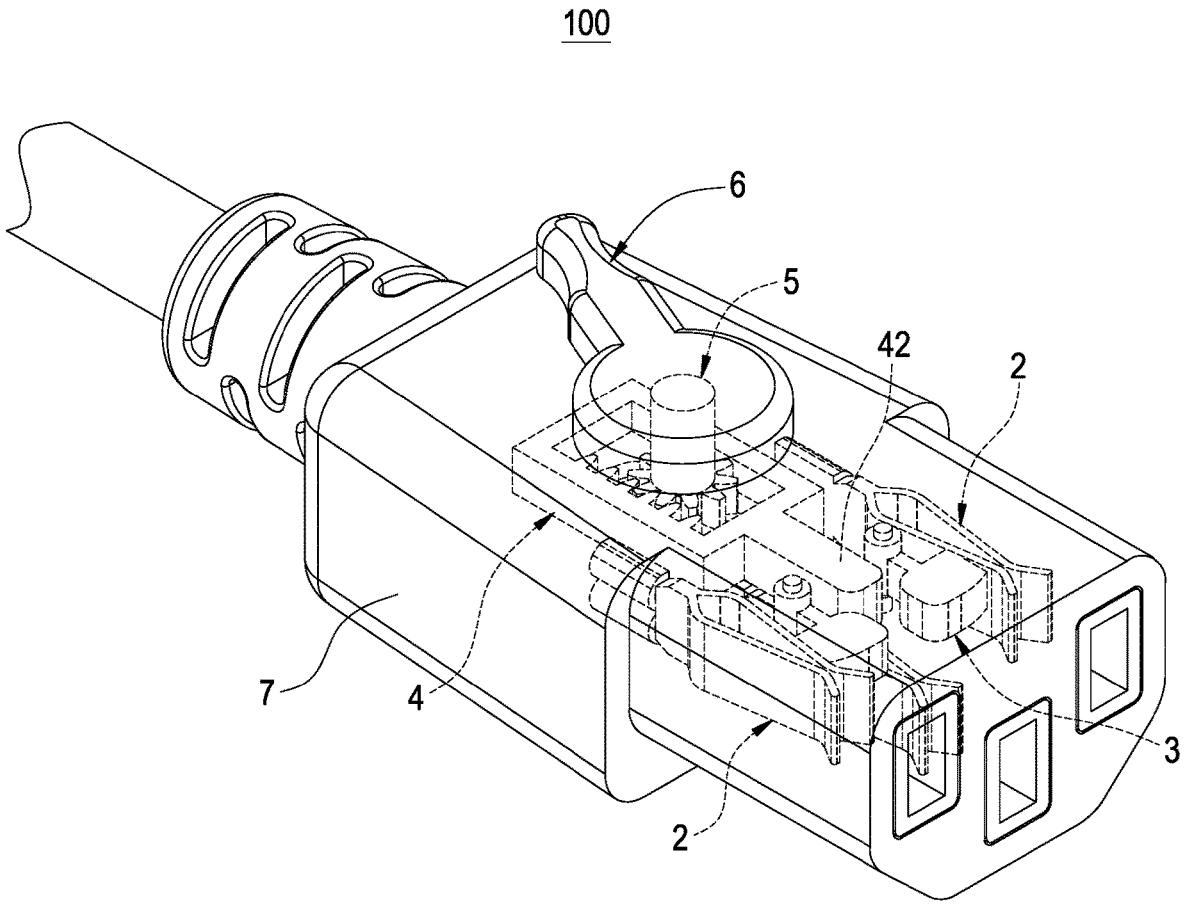
FIG. 3 is a perspective schematic view of the electric power connector with a latching function of the disclosure after assembling the control member.

Each driven element 3 is movably (including shift, swing, etc.) disposed in the carrier 1. In other words, the driven elements 3 may move relative to the carrier 1. As shown in FIGS. 1 and 3, the two driven elements 3 are separately arranged corresponding to two of the three clamping members 2. In detail, the two clamping members 2 are arranged at an interval, each driven element 3 is located between the two clamping members 2.

The sliding element 4 is slidably connected in the carrier 1. In other words, the sliding elements 4 may slide relative to the carrier 1. The sliding element 4 has a rack 411 and a pushing portion 421. In detail, the pushing portion 421 of the sliding element 4 is located between the two driven elements 3.

As for how to drive the sliding element 4 to slide relative to the carrier 1, that is not limited in the disclosure, any component which may be engaged with the rack 411 through a gear to slide the sliding element 4 is available. In the embodiment, the single gear 5 is shown as an example.

The gear 5 is rotatably connected to the carrier 1 to make the gear 5 be engaged with the rack 411. Thus, the sliding element 4 may slide by rotating the gear 5. In detail, the gear 5 is rotatably connected to the carrier 1 by a shaft (not labeled).

Figure 2:
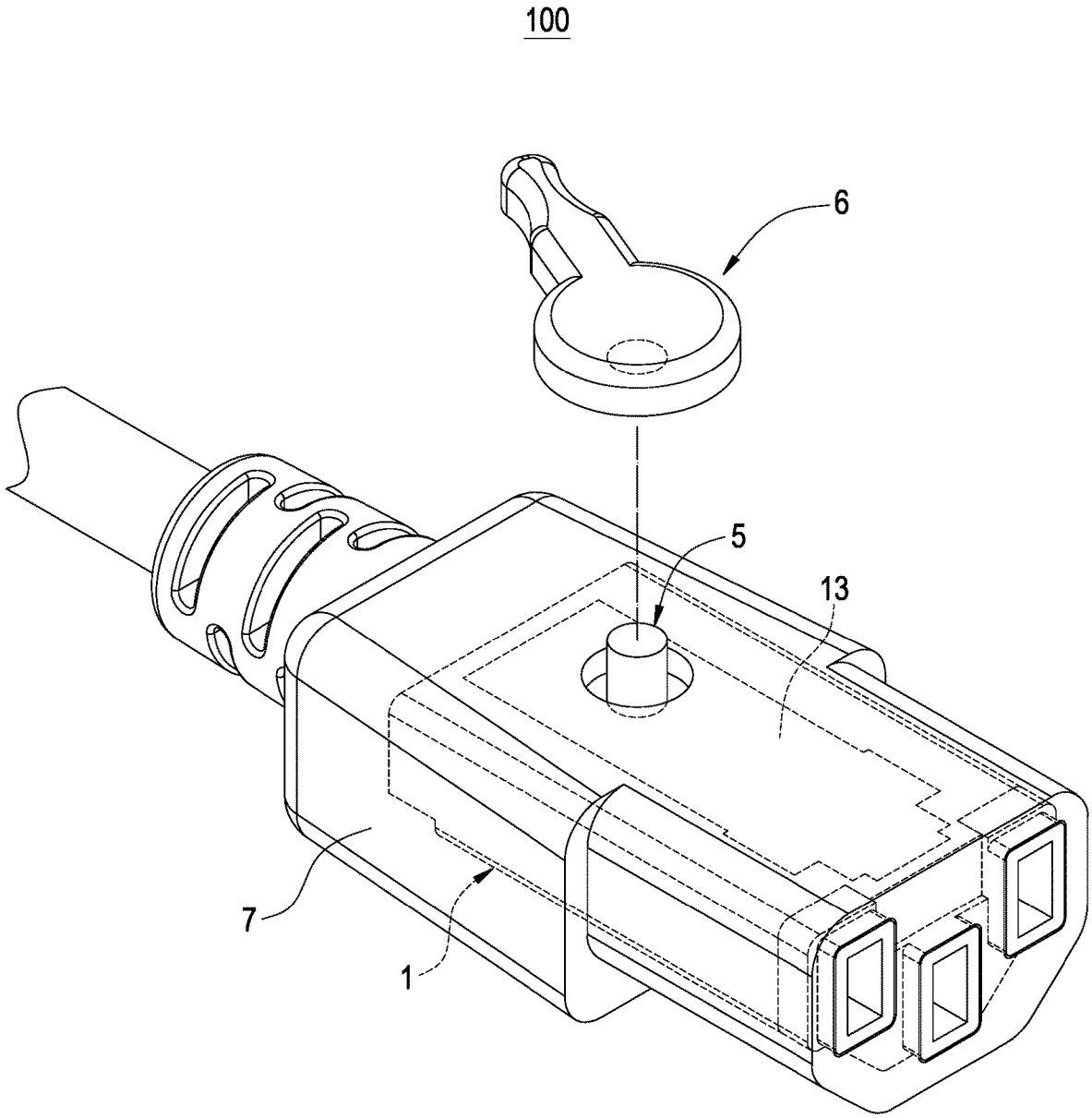
FIG. 2 is a perspective schematic view of the electric power connector with a latching function of the disclosure before assembling the control member.

The control member 6 (as shown in FIGS. 2 and 3) is directly or indirectly disposed on the gear 5. In the embodiment, an end of the control member 6 is directly disposed on the shaft of the gear 5 as an example. Thus, the gear 5 may be driven to rotate by the control member 6.

Figure 4:
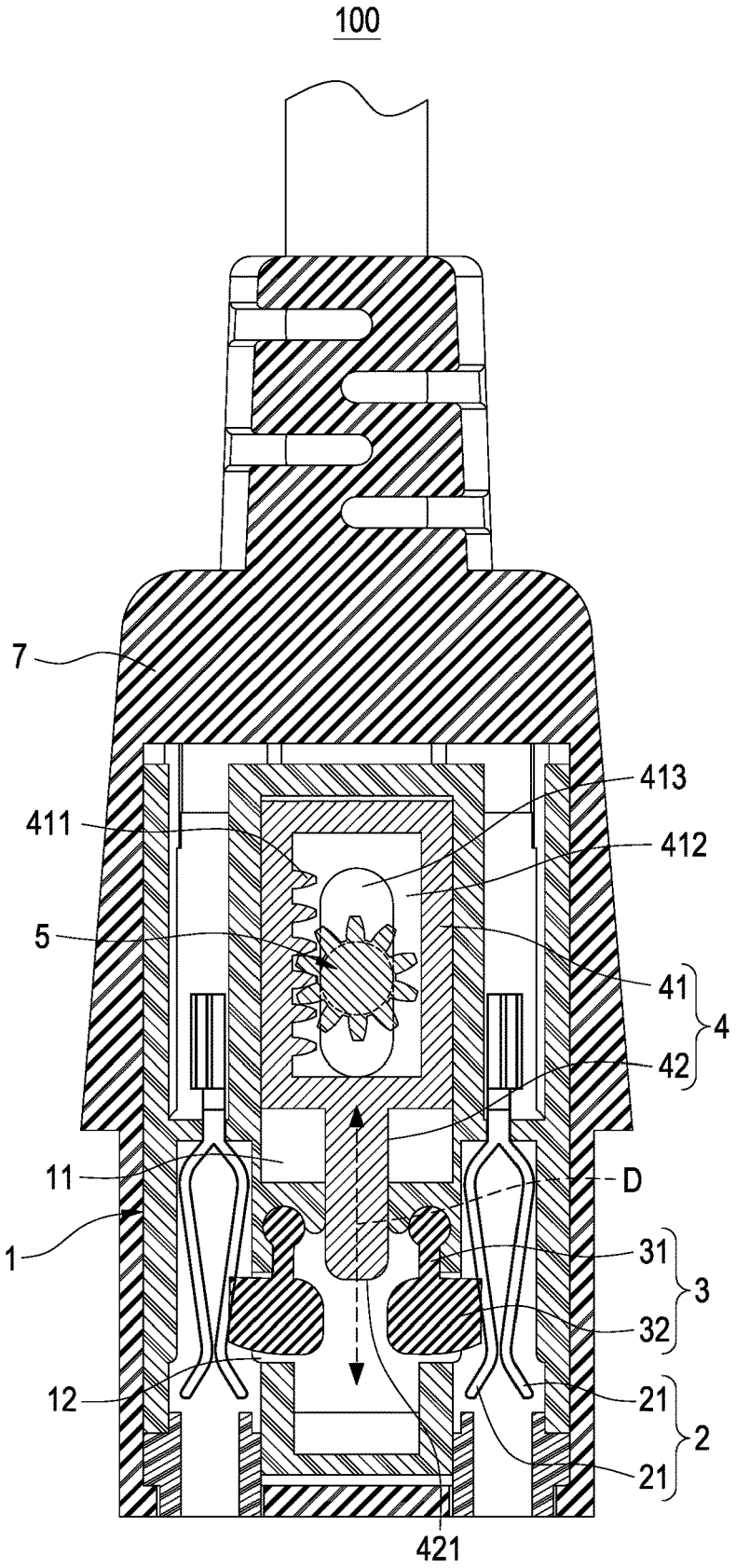
FIG. 4 is a cross-sectional view of the electric power connector with a latching function of the disclosure before assembling the control member.
Figure 6:
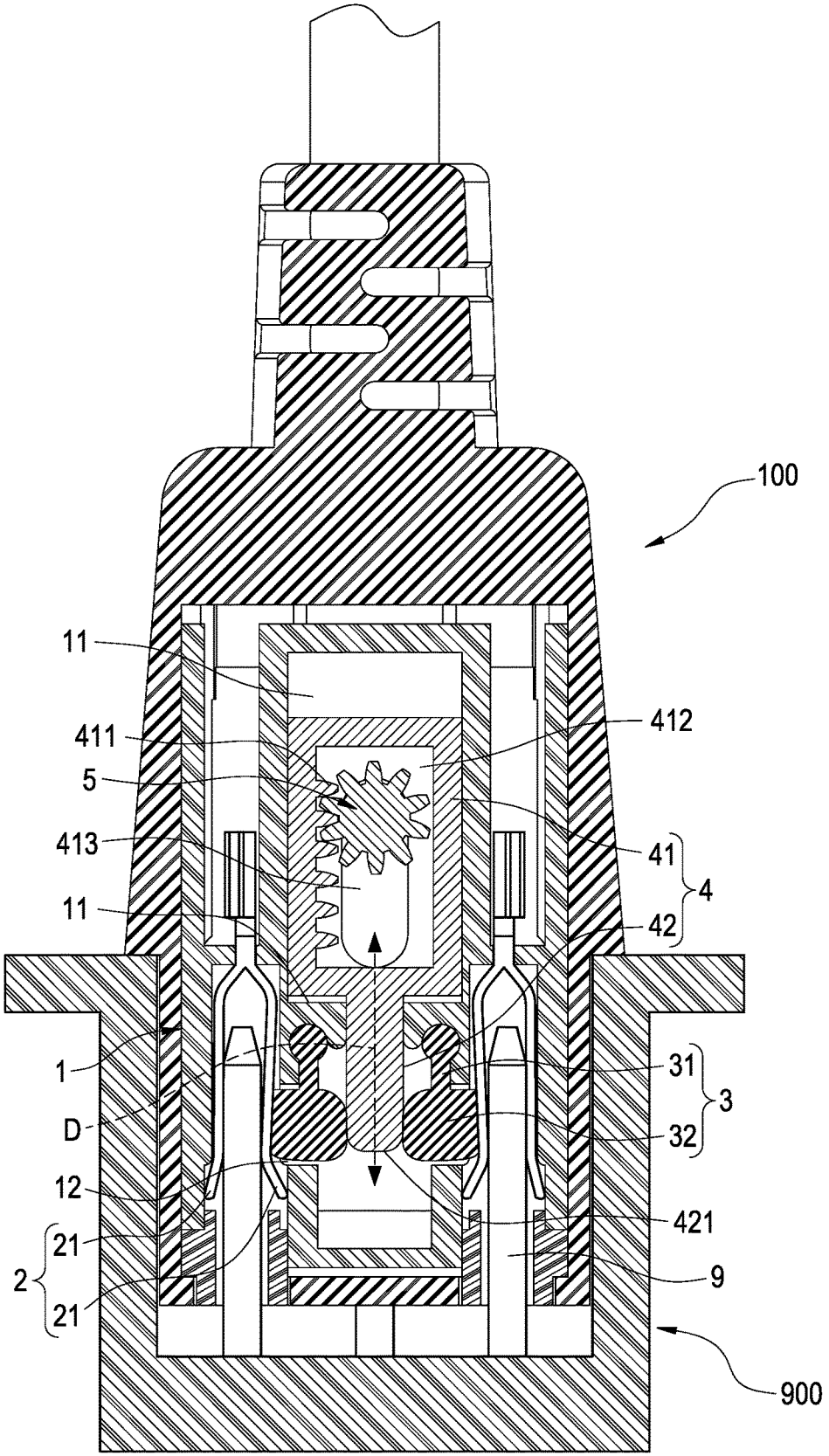
FIG. 6 is a cross-sectional view of the electric power connector with a latching function of the disclosure after latched according to FIG. 5.

As shown in FIGS. 4-6, when the electric power connector 100 is connected to the corresponding connector 900, each connective terminal 9 of the corresponding connector 900 is correspondingly plugged in each clamping member 2 of the electric power connector 100. At the same time, a user may rotate the control member 6 to drive the gear 5 to rotate to further slide the sliding element 4 relative to the carrier 1. After the sliding element 4 slides, the pushing portion 421 may move with the sliding element 4 to push the two driven elements 3 to move relative to the carrier 1 (including shift, swing, etc.) to finally force the two clamping members 2 to separately latch the two connective terminals 9. As a result, the disclosure has a firmly latching effect which may prevent the electric power connector 100 and the corresponding connector 900 from improperly separating from each other. Also, the electric power connector 100 of the disclosure has the effect of easy operation (because the disclosure is to rotate the gear 5 to drive the sliding element 4 to longitudinally and linearly shift to further push the driven element 3 to transversely and arcuately swing or transversely and linearly shift (not shown in figures), thereby being easy to operate) for both latching or unlatching (reversely rotating the control member 6 may eject the driven element 3 to unlatch). It is noted that the driven element 3 moves to push one of the two clamping arms 21 of the clamping member 2 to approach the other one of the two clamping arms 21 to force the two clamping arms 21 to clamp tightly to latch the connective terminal 9.

In detail, as shown in FIGS. 1-4, the carrier 1 may be a single piece structure (not shown) or includes a first cover 13 and a second cover 14 as shown in the figures. Each of two facing sides of the carrier 1 is formed with a carrier sliding trough 11 and multiple cavities (not labeled). The sliding element 4 is disposed in the carrier sliding trough 11. Each clamping member 2 is separately disposed in each cavity. The first cover 13 covers a facing side of the carrier 1 corresponding to the carrier sliding trough 11 in position. The second cover 14 covers the other facing side of the carrier 1 corresponding to each cavity in position. A sheathing layer 7 is formed on the outermost surface as shown in FIG. 2.

The sliding element 4 includes a frame 41 and a bar 42 protruding from an outer side of the frame 41. In some embodiments, the bar 42 is a post body with the same diameter as shown in the figures. The pushing portion 421 is formed on an end of the bar 42. The frame 41 may be a rectangular frame and is slidably disposed in the carrier sliding trough 11. The bar 42 may project from the carrier sliding trough 11 to allow the pushing portion 421 to push the driven element 3 outside the carrier sliding trough 11. The rack 411 is formed on an inner edge (not labeled) of the frame 41. The gear 5 is disposed in the frame 41 to be engaged with the rack 411.

A side of the frame 41 is sealed by a sealing plate 415. A frame sliding trough 412 is formed between the frame 41 and the sealing plate 415. The sealing plate 415 is formed with a hollow trench 413. The shaft of the gear 5 passes through the trench 413 and is rotatably connected between the carrier 1 and the first cover 13.

The driven element 3 may be a component which may be swung by a force exerted thereon. The driven element 3 is rotatably connected to the carrier 1 to allow the pushing portion 421 to push the driven element 3 to swing to force the clamping member 2 to latch the connective terminal 9. In detail, the driven element 3 includes a swinging arm 31 and a driven body 32. An outer diameter of the driven body 32 is greater than an outer diameter of the swinging arm 31. An end of the swinging arm 31 is rotatably connected between the carrier 1 and the first cover 13. The driven body 32 is connected to the other end of the swinging arm 31. The pushing portion 421 pushes each driven body 32 to separately swing each driven element 3.

As shown in FIGS. 4-6, a straight sliding direction D is defined on the carrier 1 according to the carrier sliding trough 11. The frame 41 of the sliding element 4 linearly reciprocates along the straight sliding direction D. The pushing portion 421 moves with the frame 41 to shift outside the carrier sliding trough 11 to define a shift path (not labeled, parallel to the straight sliding direction D). The driven body 32 of each driven element 3 is located on the shift path of the pushing portion 421.

In addition, the carrier 1 may further have two openings 12 as shown in FIGS. 1 and 4. The two openings 12 are separately located between the two clamping members 2 and the two driven elements 3 to make the driven body 32 of each driven element 3 push each clamping member 2 through each opening 12.

While this disclosure has been described by means of specific embodiments, numerous modifications and variations could be made thereto by those skilled in the art without departing from the scope and spirit of this disclosure set forth in the claims.

What is claimed is:

1. An electric power connector for a connective terminal to be plugged in, the electric power connector comprising:

a carrier;

at least one clamping member, disposed in the carrier, and configured to clamp the connective terminal;

at least one driven element, movably disposed in the carrier, and arranged correspondingly to the clamping member;

a sliding element, slidably connected in the carrier, and comprising a rack and a pushing portion; and a gear, rotatably connected to the carrier, and engaged with the rack;

wherein the sliding element is configured to slide relative to the carrier by controlling the gear to rotate, and the pushing portion is configured to move with the sliding element to push the driven element to shift to force the clamping member to latch the connective terminal.

2. The electric power connector of claim 1, wherein the clamping member comprises two clamping arms, the connective terminal is clamped by the two clamping arms, and the driven element is configured to push one of the two clamping arms to force the two clamping arms to latch the connective terminal.

3. The electric power connector of claim 1, wherein the driven element is swingable with respect to a force exerted thereon, the driven element is rotatably connected to the carrier and is arranged correspondingly to the clamping member, and the pushing portion is configured to push the driven element to swing to force the clamping member to latch the connective terminal.

4. The electric power connector of claim 1, wherein the clamping member is two in number, the driven element is one in number, the driven element is arranged correspondingly to one of the two clamping members, and the pushing portion is configured to push the driven element to move to force one of the two clamping members to latch the connective terminal.

5. The electric power connector of claim 1, wherein the clamping member is two in number, the driven element is two in number, each driven element is arranged correspondingly to each clamping member, the pushing portion is correspondingly located between the two driven elements, and the pushing portion is configured to push the two driven elements to move to force the two clamping members to latch two connective terminals.

6. The electric power connector of claim 5, wherein the driven elements are swingable with respect to a force exerted thereon, each driven element is rotatably connected to the carrier and is arranged correspondingly to each clamping member, and the pushing portion is configured to push the two driven elements to swing to separately force the two clamping members to latch the two connective terminals.

7. The electric power connector of claim 6, wherein the carrier comprises a carrier sliding trough, the sliding element comprises a frame and a bar protruding from the frame, the frame is slidably disposed in the carrier sliding trough, the rack is disposed on an inner edge of the frame, the gear is disposed in the frame to engage with the rack, the bar comprises the pushing portion, and the pushing portion is configured to push the driven element outside the carrier sliding trough.

8. The electric power connector of claim 7, wherein a straight sliding direction is defined on the carrier according to the carrier sliding trough, the frame is configured to linearly move along the straight sliding direction, the pushing portion is configured to move with the frame to shift outside the carrier sliding trough to define a shift path, and each driven element is located on the shift path of the pushing portion.

9. The electric power connector of claim 7, wherein a side of the frame is sealed by a sealing plate, a frame sliding trough is disposed between the frame and the sealing plate, the sealing plate comprises a trench, and the gear is located in the frame sliding trough and passes through the trench to be rotatably connected to the carrier.

10. The electric power connector of claim 7, wherein the bar is a post body with a same diameter, and the pushing portion is disposed on an end of the bar.

11. The electric power connector of claim 6, wherein the driven element comprises a swinging arm and a driven body, one end of the swinging arm is rotatably connected to the carrier, the driven body is connected to another end of the swinging arm, and the pushing portion is configured to push two driven bodies to separately swing the two driven elements.

12. The electric power connector of claim 11, wherein an outer diameter of the driven body is greater than an outer diameter of the swinging arm.

13. The electric power connector of claim 1, wherein the driven element is swingable with respect to a force exerted thereon and comprises a swinging arm and a driven body, one end of the swinging arm is rotatably connected to the carrier, the driven body is connected to another end of the swinging arm, and the pushing portion is configured to push the driven body to swing the driven element to force the clamping member to latch the connective terminal.

14. The electric power connector of claim 13, wherein an outer diameter of the driven body is greater than an outer diameter of the swinging arm.

15. The electric power connector of claim 1, further comprising: a control member, disposed on the gear and configured to drive the gear to rotate.

* * * * *